United States Patent [19]

DeStefano

[11] Patent Number: 4,726,357

[45] Date of Patent: Feb. 23, 1988

[54] APPARATUS TO AID A RESCUER IN APPLYING PULMINARY ABDOMINAL THRUSTS TO A CHOKING VICTIM FOR DISLODGING OBJECTS FROM THE THROAT OF THE VICTIM

[76] Inventor: Edward G. DeStefano, 1427 Lemhurst Rd., Pensacola, Fla. 32507

[21] Appl. No.: 11,253

[22] Filed: Feb. 5, 1987

[51] Int. Cl.[4] ..... A61H 31/00

[52] U.S. Cl. ..... 128/28; 273/58 C; 128/54

[58] Field of Search ..... 128/28, 51, 54, 55, 128/44; 272/114, 68, 67, 71, 76; 273/58 K, 65 EG, 58 C

[56] References Cited

U.S. PATENT DOCUMENTS

| | | | |
|---|---|---|---|
| 1,535,822 | 4/1925 | Goodwin | 128/28 X |
| 2,718,644 | 9/1955 | Barr | 273/58 K |
| 3,401,686 | 9/1968 | Edwards | 128/28 |
| 3,425,409 | 2/1969 | Isaacson et al. | 128/28 |
| 3,470,845 | 10/1969 | Mignano | 273/58 K X |
| 4,059,099 | 11/1977 | Davis | 128/28 |
| 4,164,216 | 8/1979 | Person | 128/28 |
| 4,182,317 | 1/1980 | Ash | 128/28 |

OTHER PUBLICATIONS

AMF Whitely Physical Fitness Products for 1980 (catalog) p. 8.

*Primary Examiner*—Richard J. Apley
*Assistant Examiner*—David Bender
*Attorney, Agent, or Firm*—George A. Bode

[57] ABSTRACT

An apparatus for applying pulminary thrusts to a choking victim for dislodging objects from the throat of the victim comprising a substantially spherically shaped body member having a pair of elongated arcuate handles fixedly attached thereto and symetrically positioned thereabout and an elongated band fixedly connected at one end thereof to the spherically shaped body member intermediate the first end portions of the pair of handles and selectively attachable therealong to a fastening member provided on the spherically shaped body intermediate second end portions of the handles.

7 Claims, 7 Drawing Figures

APPARATUS TO AID A RESCUER IN APPLYING PULMINARY ABDOMINAL THRUSTS TO A CHOKING VICTIM FOR DISLODGING OBJECTS FROM THE THROAT OF THE VICTIM

BACKGROUND OF THE INVENTION

1. Field of the Invention

The present invention relates to an apparatus to aid a rescuer in applying pulminary abdominal thrusts to a choking victim for dislodging objects from the throat of the victim. Even more particularly, the present invention relates to such an apparatus with a spherically shaped body having handles so that the user is able to perform a modified type "Heimlich Maneuver" by pulling inwardly and upwardly on the apparatus with quick, forceful thrusts to compress the upper abdomen.

2. General Background

Countless number of lives having been saved by people who have correctly applied the "Heimlich Maneuver" to a choking victim. The "Heimlich Maneuver" requires a person to wrap his arms around a choking victim's waist from behind, place one of his fist with its thumb edge on the upper abdomen and clutch the fist with the other hand and thrust quickly and forcefully inwardly and upwardly directly beneath the diaphragm to compress the upper abdomen and lungs, thus causing the lungs to expel an obstruction. Almost any blunt object that provides pressure under the breastbone will be effective. If the victim is lying down, the procedure suggests quickly placing him on his back, kneeling astride his hips and thrusting with the heel of one's hand covered by the other hand. If the victim is sitting, the maneuver can be executed much the same as if he were standing.

Several attempts have been made in the prior art to develop a device to assist in performing the "Heimlich Maneuver" on a choking victim.

U.S. Pat. No. 1,535,822 issued to R. Goodwin discloses a primarily self-administered remedial appliance for expelling gas from the stomach comprising a spherical solid member with an integral protuberance having an outwardly pointed "V" cross-section which is elongated to form a ridge which, when pressed against the upper abdominal wall, causes the proturbence to sharply indent the region of the abdominal wall which lies just beneath the sternum and opposite the ends of the upper ribs.

U.S. Pat. No. 4,059,099 issued to B. L. Davis discloses a "Heimlich Maneuver" aid providing a flat C.P.R. pad spaced medially of laterally depending handles to provide sufficient clearance between the hands of the user and the patient's body in contact with the pad during reciprocating movement of the device.

Other "Heimlich Maneuver" assist devices are depicted in U.S. Pat. Nos. 4,182,317, 3,425,409, 4,164,216, and 3,401,686.

Although these patents have attempted to fill this need, until now none has been completely successful in providing a device which increases the effectiveness of the "Heimlich Maneuver" and offers several options for its use. It allows individual who normally would not have the strength or dexterity to properly execute the "Heimlich Maneuver" to do so. Even people totally unfamilar with the technique are provided with some suggestion of how to perform the same.

Accordingly there appears to be a long standing need for an improved device which will overcome the aforementioned problems.

GENERAL DISCUSSION OF THE PRESENT INVENTION

The present invention solves the prior art problems and shortcomings in a simple, inexpensive and straightforward manner. The present invention provides for a spherically shaped body member having a pair of elongated arcuate handle means fixedly attached thereto and symetrically positioned thereabout, a flexible elongated band fixedly connected at one end to the spherically shaped body member and extending medially of the pair of handle means and means for removably fastening the other end of the elongated band to the spherically shaped body member intermediate one end of the handle means.

In the preferred operation the handle means are grasped with both hands and the user by, pulling inwardly and upwardly on the apparatus with quick, forceful thrusts, compresses the upper abdomen to cause the lungs to expel the obstruction.

The present invention has as its primary objective providing an apparatus to be used in conjunction with the medically accepted procedure known as the "Heimlich Maneuver."

It is a further objective of the present invention to provide a life saving device for drowning victims which expels water from the lungs.

It is an object of the present invention to provide an apparatus which simplifies the "Heimlich Maneuver" and reduces the chance of error or further injury to the victim while providing a more medically acceptable pulminary thrust action.

It is a further object of the present invention to provide an apparatus to aid a rescuer in applying pulminary thrusts to a choking victim for dislodging objects from the throat of the victim whether the victim be in the standing, sitting or prone position.

It is a further object of the present invention in providing such a device to increase the range of individuals capable and ready to perform the "Heimlich Maneuver" by enhancing the strength of the rescuer.

Other objects, advantages and novel features of the present invention will become apparent from the following detailed description and drawing.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
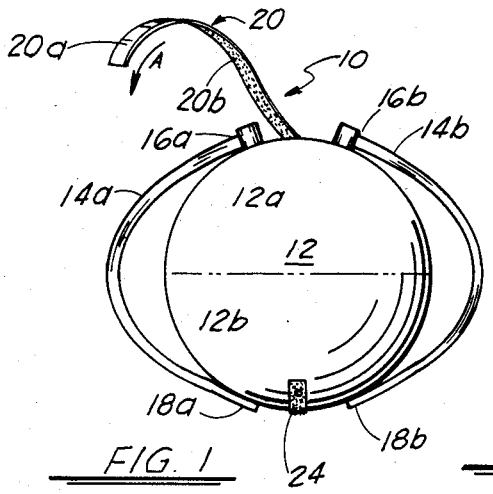
FIG. 1 is a front view of the preferred embodiment of the apparatus of the present invention.
Figure 2:
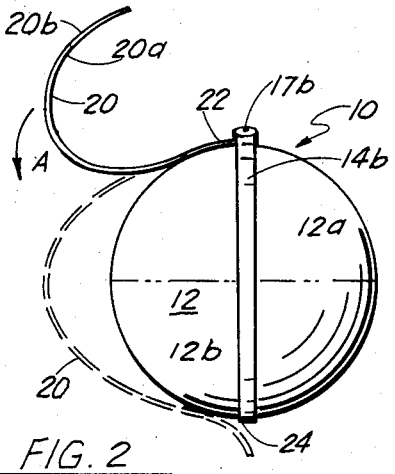
FIG. 2 is a side view of the apparatus of FIG. 1.
Figure 3:
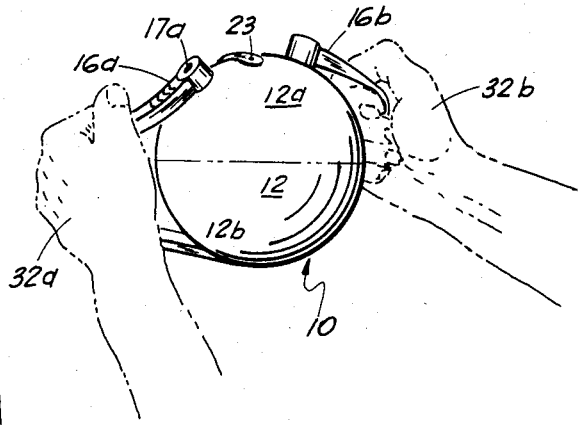
FIG. 3 is a perspective view of the apparatus of FIG. 1, as manually (in phantom) positioned for its preferred operation.

Referring now to the drawing, and particularly FIGS. 1–4, the apparatus of the present invention is designated generally by the numeral 10. Apparatus 10 to aid in applying pulminary thrusts to the abdominal area of a choking victim to dislodge objects from his throat comprises a substantially spherical body member 12, preferrably of a hard plastic or fiberglass material and hollow, so as to minimize its weight but be firm enough to withstand its intended use. Spherical body member 12 is, by definition, composed of two hemispherical portions, designated as first or upper portion 12*a* and second or lower portion 12*b*. Fixedly connected to spherically shaped body member 12 are a pair of flexible arcuate handles 14*a*, 14*b* which are symetrically positioned about body member 12 as best seen in FIGS. 1–3. In the preferred embodiment, handles 14*a*, 14*b* are of the same material as body member 12 and fixedly connected at one end portion 16*a*, 16*b* thereof to the upper or first hemispherical portion 12*a* of spherically shaped body member 12 by any conventional fastening means such as screws 17*a* (FIG. 3), 17*b* (FIG. 2); and the opposite end portion 18*a*, 18*b* of handles 14*a*, 14*b* are attached to the lower or second hemispherical portion 12*b* of spherically shaped body member 12 in a similar conventional manner (fastening means not shown). In an alternate embodiment, handles 14*a*, 14*b* can be integrally formed with spherically shaped body member 12, thus eliminating the need for any fasteners.

Figure 4:
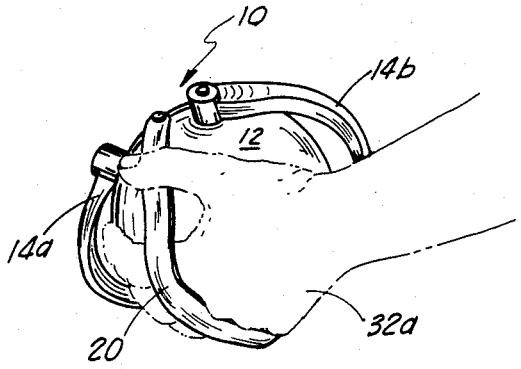
FIG. 4 is a perspective view of the apparatus of FIG. 1, as manually (in phantom) positioned for an alternate operation.

As best seen in FIGS. 1, 2 and 4, a flexible elongated band 20 is connected at one end 22 thereof to the upper or first hemispherical portion 12*a* of spherically shaped body member 12 (by any conventional means, such as screw 23, an adhesive, etc.) intermediate the upper end portions 16*a*, 16*b* of handles 14*a*, 14*b*. Elongated band member 20 when left to fall naturally, (in the direction of ARROW A) extends medially of handle members 14*a*, 14*b* and attaches at a point selectively therealong by a fastening means to fastening portion or patch 24 provided on the lower or second hemispherical portion 12*b* of spherically shaped body member 12 intermediate the second end portions 18*a*, 18*b* of handles 14*a*, 14*b*, respectively, as best seen (in phantom) in FIG. 2. Elongated band member 20 is shown in FIGS. 1 and 2 to include a velcro fastening underside 20*b* and a smooth surface on the other or top side 20*a*. Adhesively mounted on the lower or second hemispherical portion 12*b* of spherically shaped body member 12 intermediate end portions 18*a*, 18*b* of handle members 14*a*, 14*b*, respectively is fastening portion or patch 24 which comprises a patch of velcro which is the opposite type of that provided on the underside 20*b* of band 20. Thus, if the underside 20*b* of band 20 is provided with the female (loop) portion of velcro, fastener portion 24 is a patch of velcro and comprising the male (hook) portion thereof (the velcro fastening means can, of course, be reversed—the male portion on underside 20*b* and the female portion on patch 24). Thus, band 20 can be connected at its underside 20*b* to fastening portion 24 selectively along band 20, as best seen in FIG. 2, by moving band 20 in the direction of ARROW A to the phantom position of band 20 and merely pressing the female fastener portion on underside 20*b* of band 20 against male fastener portion provided on fastener portion 24 at the desired location along band 20 to accomodate hand 32*a* as seen in FIGS. 4 and 6, the operation of which will be described further hereinbelow.

In the drawings, spherically shaped member 12 has a substantially smooth surface; however, in an alternate embodiment, grooves (not shown) can be placed on the surface of spherically shaped body member 12 where the fingers of hand 32*a* would be placed to accomodate the same and enable the rescuer 30 to secure a firmer grip when preforming the operation illustrated in FIG. 6 to be described further hereinbelow.

Figure 5:
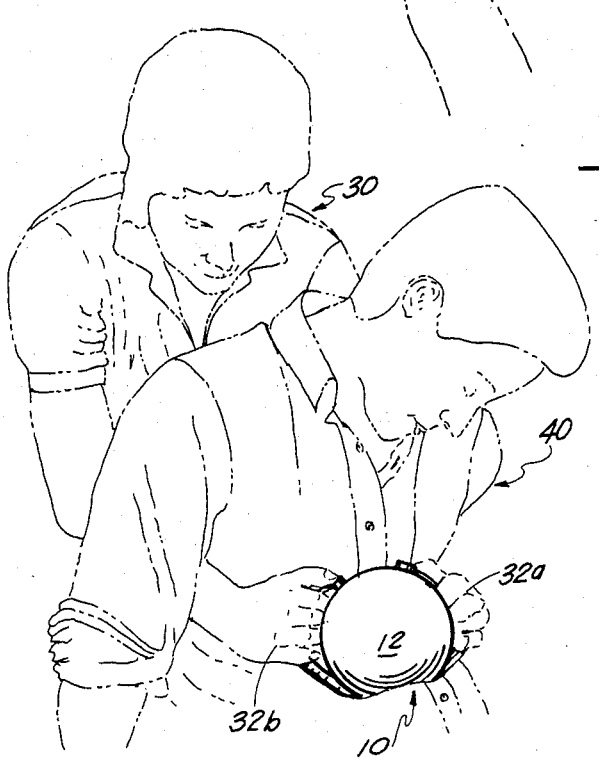
FIG. 5 is an illustration of the preferred operation of the apparatus of FIG. 1.

Referring now to FIGS. 3 and 5, the preferred method of operation of apparatus 10 is to grasp handle means 14*a*, 14*b* one with each hand 32*a*, 32*b*, respectively. Temporarily releasing the grasp of one of the hands 32 from one of handles 14, the rescuer 30 wraps his arms 32 around the waist of choking victim 40 from behind and then regrasps the handle 14 which was temporarily released. Now again firmly grasping handles 14 with hands 32, the rescuer 30 pulls inwardly and upwardly on apparatus 10 with quick forceful thrusts to compress the upper abdomen of victim 40, thus, compressing his lungs and causing the lungs to expel the obstruction caught in the throat of victim 40. The force applied by apparatus 10 to victim 40's upper abdomen is directly beneath the diaphragm area.

Figure 6:
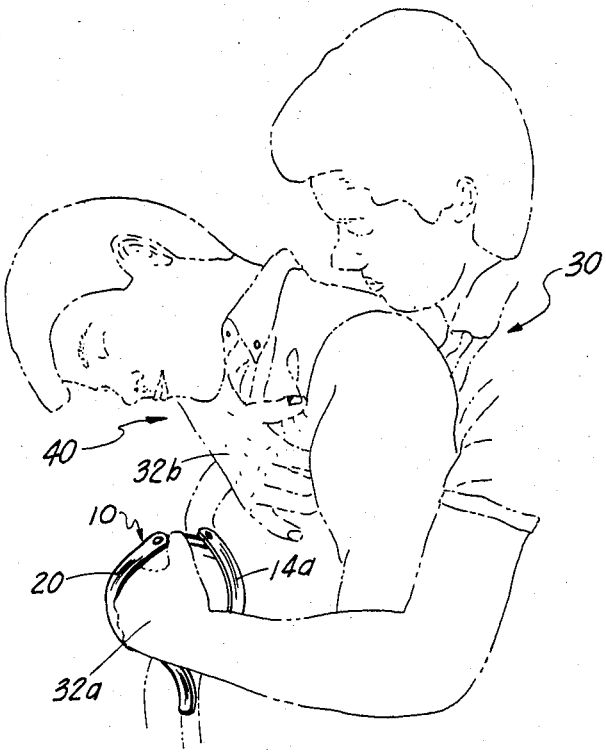
FIG. 6 is an illustration of an alternate operation of the apparatus of FIG. 1.

An alternate application of apparatus 10 is shown in FIGS. 4 and 6. If victim 40 is unconscious or rescuer 30 does not have the strength to both support victim 30 in the standing position and apply the maneuver, rescuer 30 can place his hand 32*a* around spherical body member 12 and place elongated band 20 over his hand 32*a* and secure it by attaching the underside 20*b* of strap 20 to fastener portion 24 at a selected point along band 20 and thus be sure that apparatus 10 is securely fastened to his hand 32*a*. Then rescuer 30 can, to the best of his ability, support victim 40 in a sitting or slumped position with the other free hand 32*b*, and with hand 32*a* having apparatus 10 secured thereto, apply the modified "Heimlich Maneuver" using short "thumping" thrusts quickly and firmly in order to generate the desired force using only one hand to achieve the same result discussed in the preferred operation and as illustrated in FIG. 6.

Figure 7:
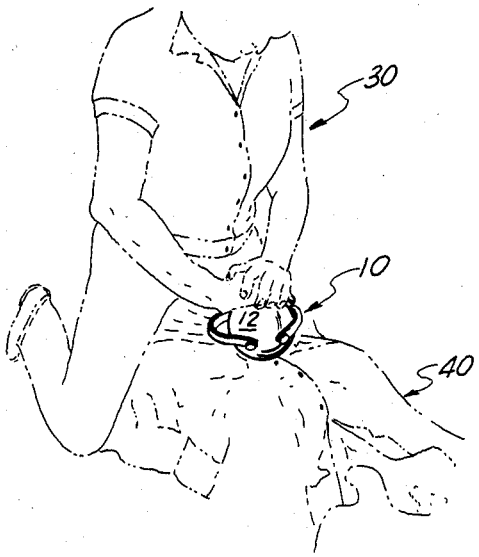
FIG. 7 is an illustration of still another alternate operation of the apparatus of FIG. 1.

Yet still another application is best seen in FIG. 7. If the victim 40 is prostrate, apparatus 10 should be employed as depicted in FIG. 4 and with rescuer 30 kneeling astride victim 40, thrusts should be applied quickly and firmly to the upper abdominal area below the diaphragm.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. The invention is to be limited only by the scope of the claims appended hereto.

What is claimed this invention is:

1. A hand held apparatus to aid in applying pulminary thrusts to a choking victim for dislodging objects from the throat of the victim comprising:

a. a substantially spherically shaped body member having first and second hemispherical portions and a pair of elongated handle means fixedly attached thereto and symetrically positioned thereabout, each of said elongated handle means being arcuately shaped and fixedly connected to said spherically shaped body member at the end portions thereof to accomodate the hands, the first end portion of each of said handle means being connected to said body member on said first of said hemispherical portions of said body member and the second end portion of said handle means being connected to said body member on the second of said hemispherical portions thereof;

b. a flexible elongated band for accomodating one of the hands, said band being fixedly connected at one end thereof to said first hemispherical portion of said spherically shaped body member; and, c. means for fastening said elongated band selectively therealong to said spherically shaped body member on said second of said hemispherical portions thereof, said fastening means including a portion thereof being provided on said second of said hemispherical portions of said spherically shaped body member and intermediate said second end portions of said handle means, thereby positioning said band medially of said handle means.

2. The apparatus of claim 1 wherein said fastening means further comprises first means attached to one side of said band for reciprocally mating and engaging second means attached to said portion provided on said second of said hemispherical portions of said spherically shaped body member.

3. The apparatus of claim 2, wherein said end portions of said handle means are integrally formed with said spherically shaped body member.

4. A hand held apparatus to aid in applying pulminary thrusts to a choking victim for dislodging objects from the throat of the victim comprising:

a. a substantially spherically shaped body member having first and second hemispherical portions;

b. a pair of elongated handle means fixedly attached to said substantially spherically shaped body member and symetrically positioned thereabout, each of said handle means being arcuately shaped and fixedly connected to said spherically shaped body member at the end portions thereof to accomodate the hands, the first end portion of each of said handle means being connected to said body member on said first of said hemispherical portions of said body member and the second end portion of said handle means being connected to said body member on said second of said hemispherical portions thereof;

c. a flexible elongated band to accomodate one of the hands fixedly connected at one end thereof to said first of said hemispherical portions of said spherically shaped body member;

d. means for fastening said elongated band selectively therealong to said spherically shaped body member in said second of said hemispherical portions thereof, said fastening means including a portion thereof being provided on said second of said hemispherical portions of said spherically shaped body member and intermediate said second end portion of said handle means, thereby positioning said band medially of said handle means.

5. The apparatus of claim 4 wherein said fastening means further comprises first means attached to one side of said band for reciprocally mating and engaging second means attached to said portion provided on said second of said hemispherical portions of said spherically shaped body member.

6. A hand held apparatus to aid in applying pulminary thrusts to a choking victim for dislodging objects from the throat of the victim comprising:

a. a substantially spherically shaped body member having upper and lower hemispherical portions;

b. a pair of elongated handle means fixedly attached to said substantially spherically shaped body member and symetrically postioned thereabout, each of said handle means being arcuately shaped and fixedly connected to said spherically shaped body member at the end portions thereof to accomodate the hands, the first end portion of each of said handle means being connected to said body member on said upper hemispherical portion of said body member and the second end portion of said handle means being connected to said body member on said lower hemispherical portion thereof;

c. a flexible elongated band for accomodating one of the hands, said band being fixedly connected at one end thereof to said upper hemispherical portion of said spherically shaped body member;

d. means for removably fastening said elongated band selectively therealong to said spherically shaped body member in said lower hemispherical portion thereof, said fastening means including a portion thereof being provided on said lower hemispherical portion of said spherically shaped body member and intermediate said second end portion of said handle means on said lower hemispherical portion of said body member, thereby positioning said band medially of said handle means, said fastening means further comprising first means attached to one side of said band for reciprocally mating and engaging second means attached to said portion provided on said second hemispherical portion of said spherically shaped body member.

7. The apparatus of claim 6, wherein said first means attached to one side of said band for reciprocally mating and engaging and said second means attached to said portion provided on said lower hemispherical portion of said spherically shaped body member are Velcro portions.

* * * * *